US010434628B2

(12) United States Patent
Chen

(10) Patent No.: US 10,434,628 B2
(45) Date of Patent: Oct. 8, 2019

(54) GRINDING MACHINE

(71) Applicant: X'POLE PRECISION TOOLS INC., Taoyuan (TW)

(72) Inventor: Bach Pangho Chen, Claremont, CA (US)

(73) Assignee: X'POLE PRECISION TOOLS INC., Taoyuan (TW)

( * ) Notice: Subject to any disclaimer, the term of this patent is extended or adjusted under 35 U.S.C. 154(b) by 235 days.

(21) Appl. No.: 15/633,681

(22) Filed: Jun. 26, 2017

(65) Prior Publication Data

US 2018/0369987 A1 Dec. 27, 2018

(51) Int. Cl.
*B24B 55/10* (2006.01)
*B24B 23/02* (2006.01)

(52) U.S. Cl.
CPC ..... *B24B 55/102* (2013.01); *B24B 23/02* (2013.01); *B24B 23/026* (2013.01); *B24B 23/028* (2013.01); *B24B 55/10* (2013.01)

(58) Field of Classification Search
CPC ..... B24B 23/02; B24B 23/026; B24B 23/028; B24B 55/10; B24B 55/102; B24B 55/105; B24B 55/107
See application file for complete search history.

(56) References Cited

U.S. PATENT DOCUMENTS 3,646,712 A * 3/1972 Quintana ..... B24B 55/102 451/359
4,058,936 A * 11/1977 Marton ..... B24B 55/102 451/359
4,296,572 A * 10/1981 Quintana ..... B23Q 11/0046 451/356
4,531,329 A * 7/1985 Huber ..... B24B 55/102 451/344
5,651,727 A * 7/1997 Weinstein ..... B24B 23/00 451/344

(Continued)

FOREIGN PATENT DOCUMENTS

CN 1748939 A 3/2006
EP 2 479 001 A1 7/2012

(Continued)

*Primary Examiner* — Timothy V Eley
(74) *Attorney, Agent, or Firm* — Muncy, Geissler, Olds & Lowe, PC

(57) ABSTRACT

A grinding machine includes a grinding machine body and a grinding disc connected to the grinding machine body. The grinding machine body is provided with a pressure cavity at a position facing the grinding disc and a gas intake pipe corresponding to the pressure cavity. A pressure release gap in communication with the pressure cavity is formed between the grinding machine body and the grinding disc. The gas intake pipe induces a high-pressure gas into the pressure cavity, which receives an effect of the high-pressure gas to become a positive-pressure environment. The high-pressure gas is continually released via the pressure release gap to prohibit external dust from entering the pressure cavity. Thus, the grinding machine is capable of preventing dust from accumulating in the pressure cavity as well as effectively preventing moisture from entering the pressure cavity when the grinding machine is applied for wet grinding.

18 Claims, 9 Drawing Sheets

(56) References Cited

U.S. PATENT DOCUMENTS

| | | | | |
|---|---|---|---|---|
| 6,343,982 | B1 * | 2/2002 | Sun | B24B 23/03 451/344 |
| 6,447,387 | B1 * | 9/2002 | Tseng | B24B 23/03 451/359 |
| 6,616,518 | B2 * | 9/2003 | Sun | B24B 55/102 451/357 |
| 6,802,766 | B2 | 10/2004 | Liu | |
| 7,220,174 | B2 * | 5/2007 | Phillips | B24B 7/184 451/354 |
| 7,270,598 | B2 * | 9/2007 | Dutterer | B24B 23/03 451/343 |
| 7,722,438 | B1 | 5/2010 | Bevard et al. | |
| 2015/0104998 | A1 * | 4/2015 | Fuller | B24B 23/005 451/28 |
| 2016/0121455 | A1 * | 5/2016 | Miller | F16B 7/042 451/453 |
| 2016/0158920 | A1 * | 6/2016 | Valentini | B24B 55/102 451/357 |
| 2017/0165807 | A1 * | 6/2017 | Milli | B24B 23/02 |

FOREIGN PATENT DOCUMENTS

| | | | |
|---|---|---|---|
| EP | 3 028 811 | A1 | 6/2016 |
| EP | 2 611 573 | | 3/2017 |
| JP | 2012-210691 | A | 11/2012 |
| JP | 2014-039975 | A | 3/2014 |
| JP | 2014-124752 | A | 7/2014 |
| JP | 2014-217920 | A | 11/2014 |
| JP | 5682410 | | 1/2015 |
| JP | 5696488 | | 2/2015 |
| JP | 5760892 | | 6/2015 |
| TW | 439616 | | 6/2001 |

* cited by examiner

GRINDING MACHINE

FIELD OF THE INVENTION

The present invention relates to a grinding machine, and particularly to a grinding machine that forms a positive pressure environment between a grinding machine body and a grinding disc to eliminate invasion of dust and moisture.

BACKGROUND OF THE INVENTION

In current grinding machines, associated industrialists commonly provide a dust sucking structure on the grinding machines. The dust sucking structure sucks dust generated during a process of grinding a material under grinding, as disclosed in TW 439616, CN 1748939, U.S. Pat. Nos. 6,802,766, 7,722,438, JP5760892, JP5696488, JP5682410, JP2014217920, JP2014124752, JP2014039975, JP2012210691, EP2479001, EP3028811 and EP2611573 patents.

However, in the above implementation method, dust may be inappropriately accumulated on a grinding disc and a transmission member of a power assembly. As a result, friction is constantly produced between the transmission member and dust to cause a temperature rise in the transmission member, which disfavors long-term implementation.

Further, a grinding environment of the grinding machine is not limited to only dry grinding but also includes wet grinding. If wet grinding is performed using conventional technologies of the above patents, moisture or water, which is not easy to clean, may be drawn by the dust and enter the grinding machine. If the grinding machine is disassembled to allow moisture or water to evaporate each time the grinding machine is used after grinding, more grinding machines need to be purchased in order to use the grinding machines in turn, leading to increased costs. Further, disassembling the grinding machines also causes a waste in working hours. In addition, industries today are gradually evolving into implementation conducted by robots, and working hours of the robots may be reduced if grinding machines installed on the robots need to be disassembled from the robots in the long run.

SUMMARY OF THE INVENTION

It is a primary object of the present invention to solve issues of the susceptibility to effects of a grinding environment and inappropriate accumulation of dust of a conventional dust sucking structure.

To achieve the above object, the present invention provides a grinding machine including a grinding machine body and a grinding disc connected to the grinding machine body. The grinding machine body is provided with a pressure cavity at a position facing the grinding disc, and a gas intake pipe corresponding to the pressure cavity. A pressure release gap in communication with the pressure cavity is formed between the grinding machine body and the grinding disc. The gas intake pipe induces a high-pressure gas into the pressure cavity. The pressure cavity receives an effect of the high-pressure gas to cause its internal pressure to be greater than the pressure outside the grinding machine body, such that the pressure cavity becomes a positive-pressure environment. The pressure cavity is in communication with the pressure release gap to allow the high-pressure gas to be continually released via the pressure release gap, so as to prohibit external dust from entering the pressure cavity.

In one embodiment, the gas intake pipe is connected to an external gas source, and receives the high-pressure gas from the external gas source.

In one embodiment, the grinding machine body includes a host housing and a cover body connected to the host housing. The gas intake pipe is disposed on the cover body, which defines the pressure cavity and has its one side facing the grinding disc appear hollow to allow the high-pressure gas to flow towards the pressure release gap.

In one embodiment, the cover body includes a first end connected to the host housing and a second end facing the grinding disc. The size of the second end is greater than the size of the first end.

In one embodiment, the grinding machine body includes a connecting member, which is disposed in the cover body and causes the grinding disc to be linked with a power assembly disposed in the host housing.

In one embodiment, the grinding machine body includes the host housing and a gas guiding pipe. The host housing includes a cavity for disposing the power assembly, a gas intake channel in communication with the cavity and receiving the high-pressure gas from the external gas source, and a gas output channel in communication with the cavity and discharging the high-pressure gas out of the cavity. The gas guiding pipe has its two ends respectively connected to the gas output channel and the gas intake channel to guide the high-pressure gas into the pressure cavity.

In one embodiment, the grinding machine body includes a regulating valve connected to the gas output channel and the gas guiding pipe.

In one embodiment, the grinding machine body includes a coupling tube. The coupling tube includes a first channel connected to the gas output channel and the gas guiding pipe, and a second channel branched from and in communication with the first channel and causing a part of the high-pressure gas to be released.

In one embodiment, the coupling tube includes a deflation control member disposed in the second channel. The deflation control member includes a plug body and a through hole disposed on the plug body.

According to the disclosed embodiments of the present invention, the present invention includes following features compared to the prior art. In the present invention, the pressure cavity becomes a positive-pressure environment because of the high-pressure gas, and the high-pressure is caused to be discharged via the pressure release gap, such that not only dust is prohibited from entering the pressure cavity but also the pressure cavity is kept dry. Further, components of the grinding machine disposed in the pressure cavity are provided with better heat dissipation. In addition, while the high-pressure gas is being discharged via the pressure release gap, the high-pressure gas drives the airflow around the grinding machine to further prohibit the dust from entering the pressure cavity.

DETAILED DESCRIPTION OF THE PREFERRED EMBODIMENTS

Details and technical contents of the present invention are given with the accompanying drawings below.

Figure 1:
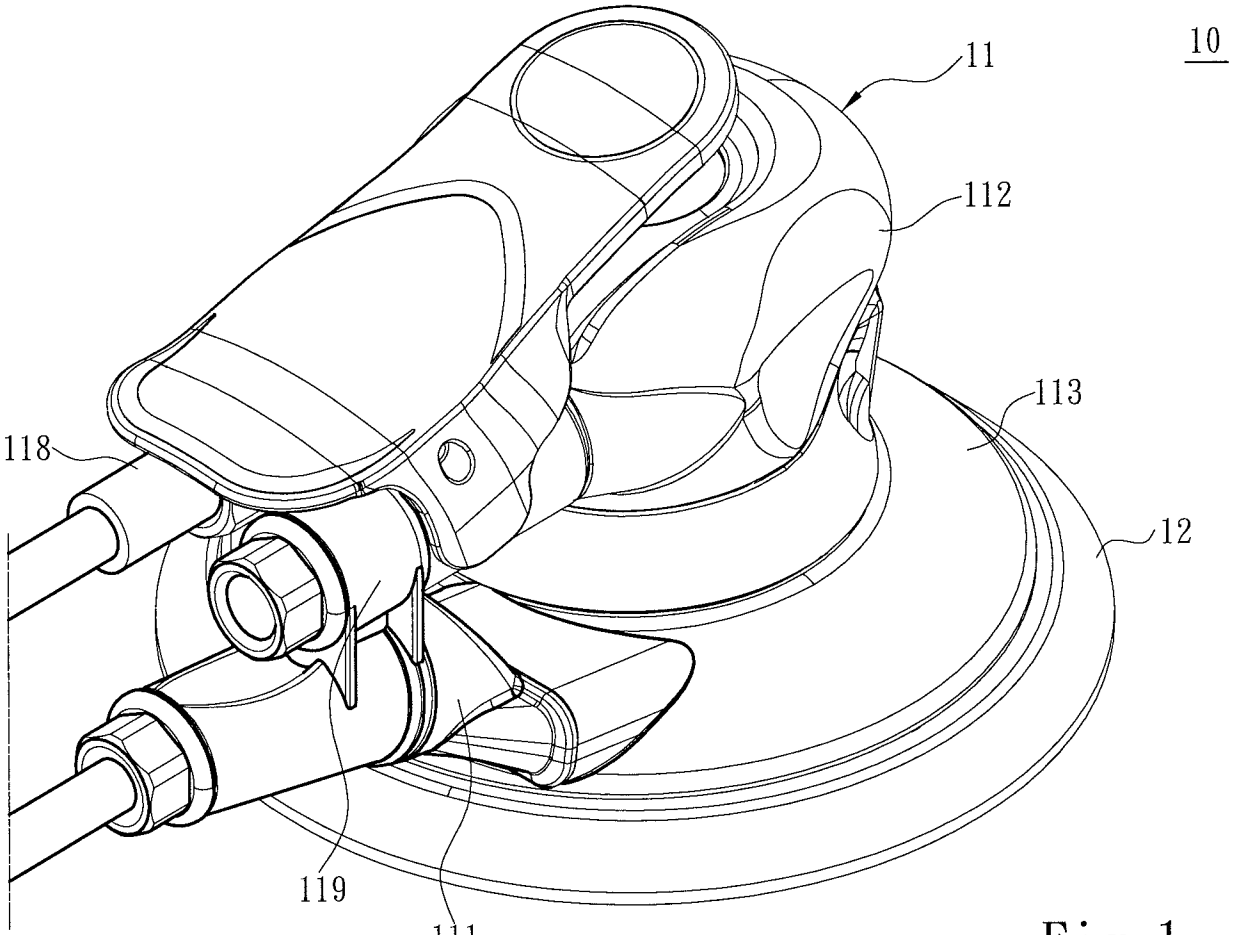
FIG. 1 is a structural schematic diagram of a grinding machine according to an embodiment of the present invention.
Figure 2:
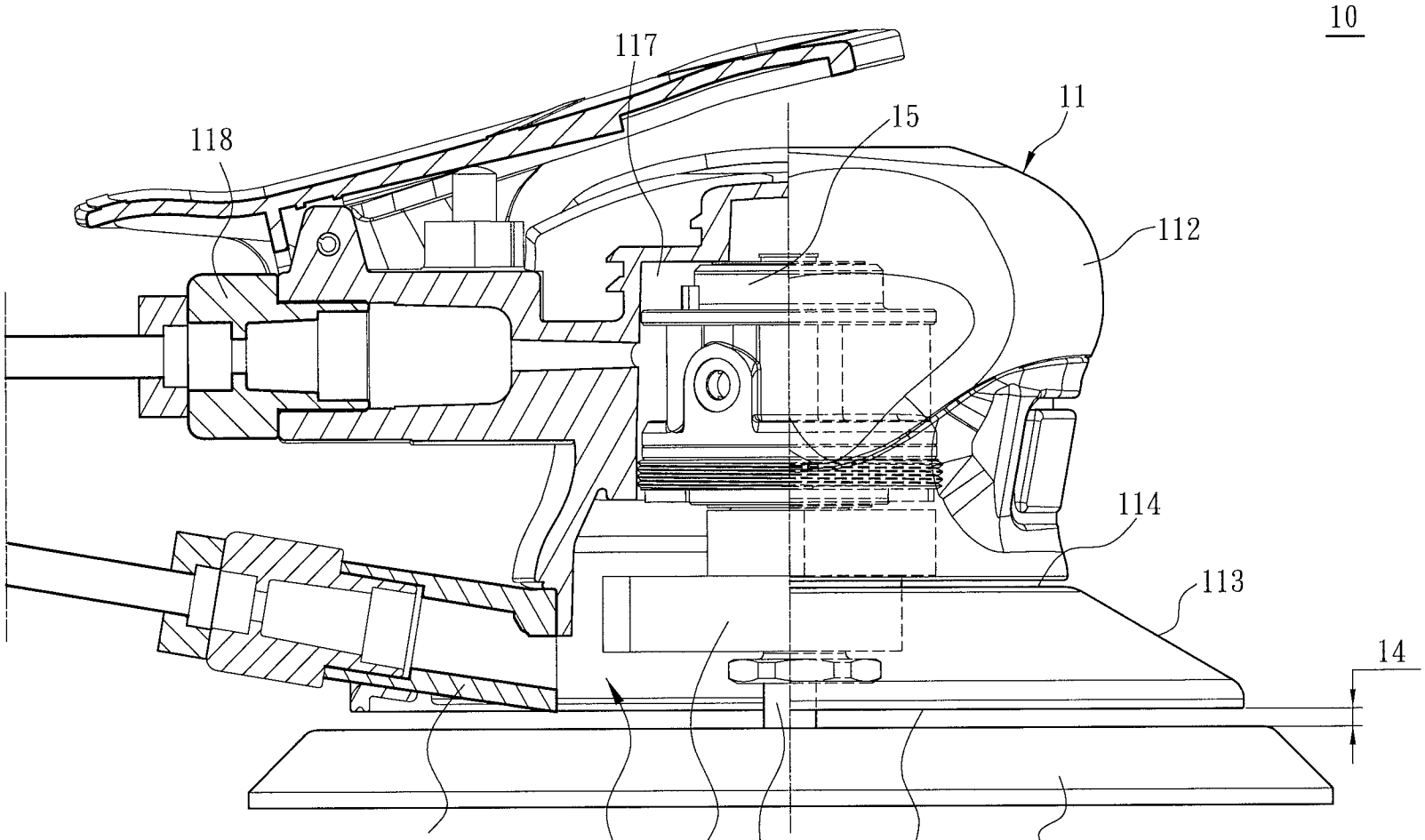
FIG. 2 is a partial sectional structural schematic diagram of a grinding machine according to an embodiment of the present invention.

Referring to FIG. 1 and FIG. 2, the present invention provides a grinding machine 10, which primarily includes a grinding machine body 11 and a grinding disc 12 connected to the grinding machine body 11. The grinding machine body 11 is provided with a pressure cavity 13 at a position facing the grinding disc 12, and a gas intake pipe 111 corresponding to the pressure cavity 13. The gas intake pipe 111 is in communication with the pressure cavity 13. Further, a lower edge of the grinding machine body 11 is not closely connected to the grinding disc 12, so as to fouls a pressure release gap 14 in communication with the pressure cavity 13. More specifically, the grinding machine body 11 has its one side facing the grinding disc 12 designed as recessed to form the pressure cavity 13. That is to say, the pressure cavity 13 and the pressure release gap 14 are in fact in communication. Further, in one embodiment, the grinding machine body 11 includes a host housing 112 and a cover body 113 connected to the host housing 112. The cover body 113 is not in close contact with the grinding disc 12, so as to form the pressure release gap 14. Further, the cover body 113 may appear slightly similar to an umbrella to define the pressure cavity 13, and has its one side facing the grinding disc 12 appear hollow to cause the pressure cavity 13 to be in direct communication with the pressure release gap 14. Further, the cover body 113 includes a first end 114 connected to the host housing 112, and a second end 115 connected to and facing the grinding disc 12. In one embodiment, the size of the second end 115 is greater than the size of the first end 114, as shown in FIG. 2. On the other hand, the grinding machine body 11 includes a connecting member 116, which is disposed at the cover body 113 and causes the grinding disc 12 to be linked with a power assembly 15 disposed in the host housing 112. Further, the connecting member 116 is installed on a transmission shaft 151 of the power assembly 15. When the power assembly 15 is activated and rotates, the transmission shaft 151 drives the connecting member 116 to rotate to further rotate the grinding disc 12. Further, the connecting member 116 may be a counterweight to stabilize the rotation of the grinding disc 12 though counterweight.

Figure 3:
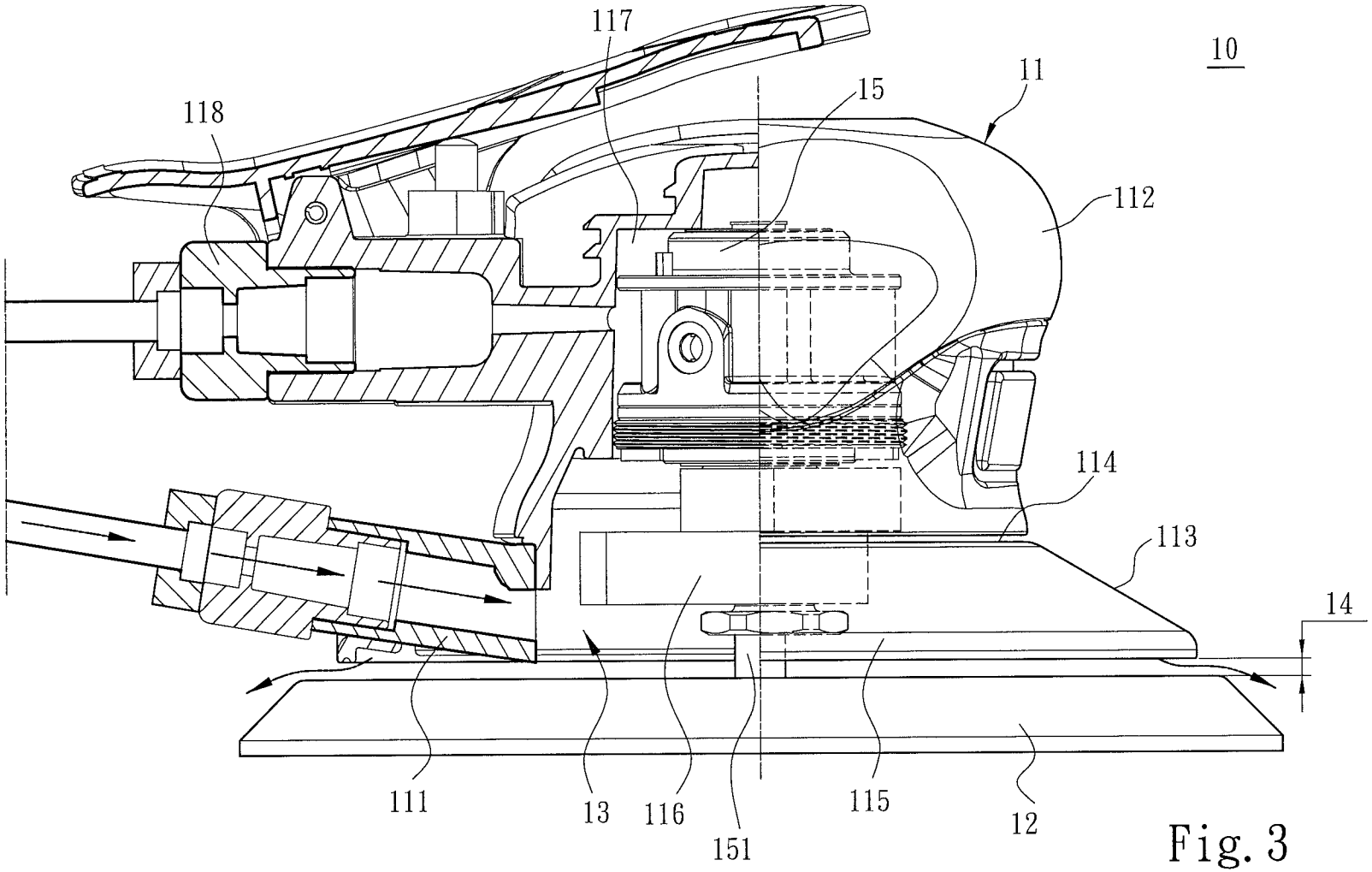
FIG. 3 is a first schematic diagram of a high-pressure gas in flow according to an embodiment of the present invention.
Figure 4:
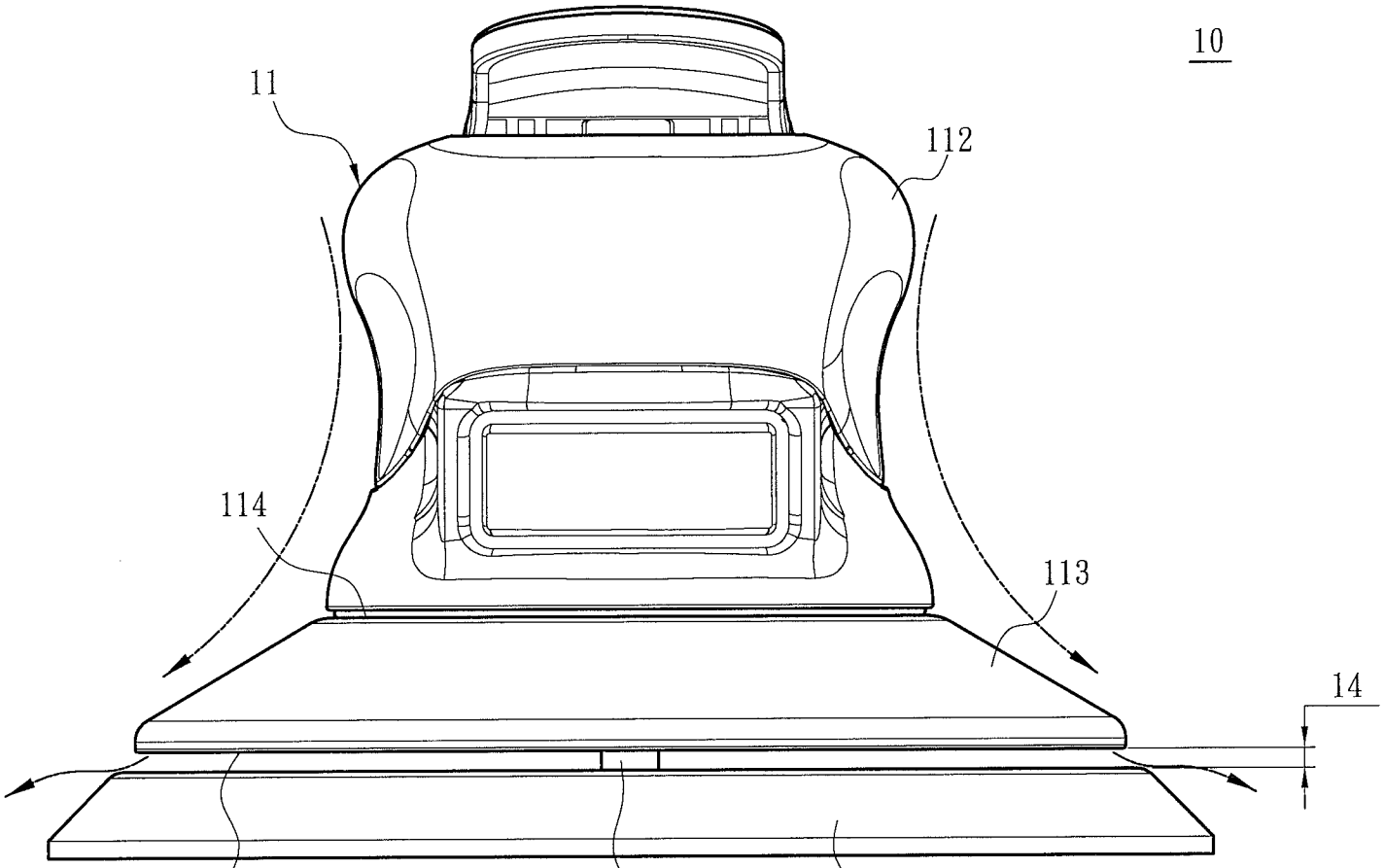
FIG. 4 is a second schematic diagram of a high-pressure gas in flow according to an embodiment of the present invention.

The gas intake pipe 111 of the present invention may be connected to an external gas source (not shown), and induces a high-pressure gas to enter the pressure cavity 13 when the external gas source is activated. At this point, the pressure in the pressure cavity 13 suddenly becomes greater than the pressure outside the pressure cavity 13 due to the high-pressure gas induced. That is too say, the pressure in the pressure cavity 13 is greater than the pressure outside the grinding machine body 11. As such, the pressure cavity 13 becomes a positive-pressure environment. The high-pressure gas is later continually released via the pressure release gap 14, and a flow of the gas pressure is as shown in FIG. 3. Referring to FIG. 4, when the high-pressure gas exists via the pressure release gap 14, gas around the grinding machine body 11 is driven by the high-pressure gas to flow along the direction of the high-pressure gas. As a result, the flow of the airflow of the grinding disc 12 becomes even more obvious to further substantially prohibit dust generated during an operation of the grinding machine 10 from entering the pressure cavity 13. Further, in the present invention, the high-pressure gas is caused to enter the pressure cavity 13, such that moisture or water seeping into the pressure cavity 13 is blown dry by the high-pressure gas when the grinding machine 10 performs wet grinding. Thus, the pressure cavity 13 of the grinding machine 10 can be appropriately kept dry to prevent a part of the components of the grinding machine 10 from corrosion caused by accumulated moisture or water. Further, through such design of the present invention, the grinding machine 10 is adaptable to various grinding environments (e.g., wet grinding or dry grinding), so as to reduce the frequency of post-implementation equipment maintenance and to be readily installed to a mechanical arm (not shown). Further, through the above technical solution, the transmission shaft 151 and nearby structures may be blown by the high-pressure gas during a grinding process, such that thermal exchange may be performed to prevent heat from accumulating on the transmission shaft 151 and the nearby structures.

Although the grinding machine 10 implemented by a pneumatic approach is illustrated in FIG. 1 as an example, it should be noted that the embodiments of the present invention are not limited to the pneumatic grinding machine 10, and may be applied to the grinding machine 10 implemented by an electric approach.

Figure 5:
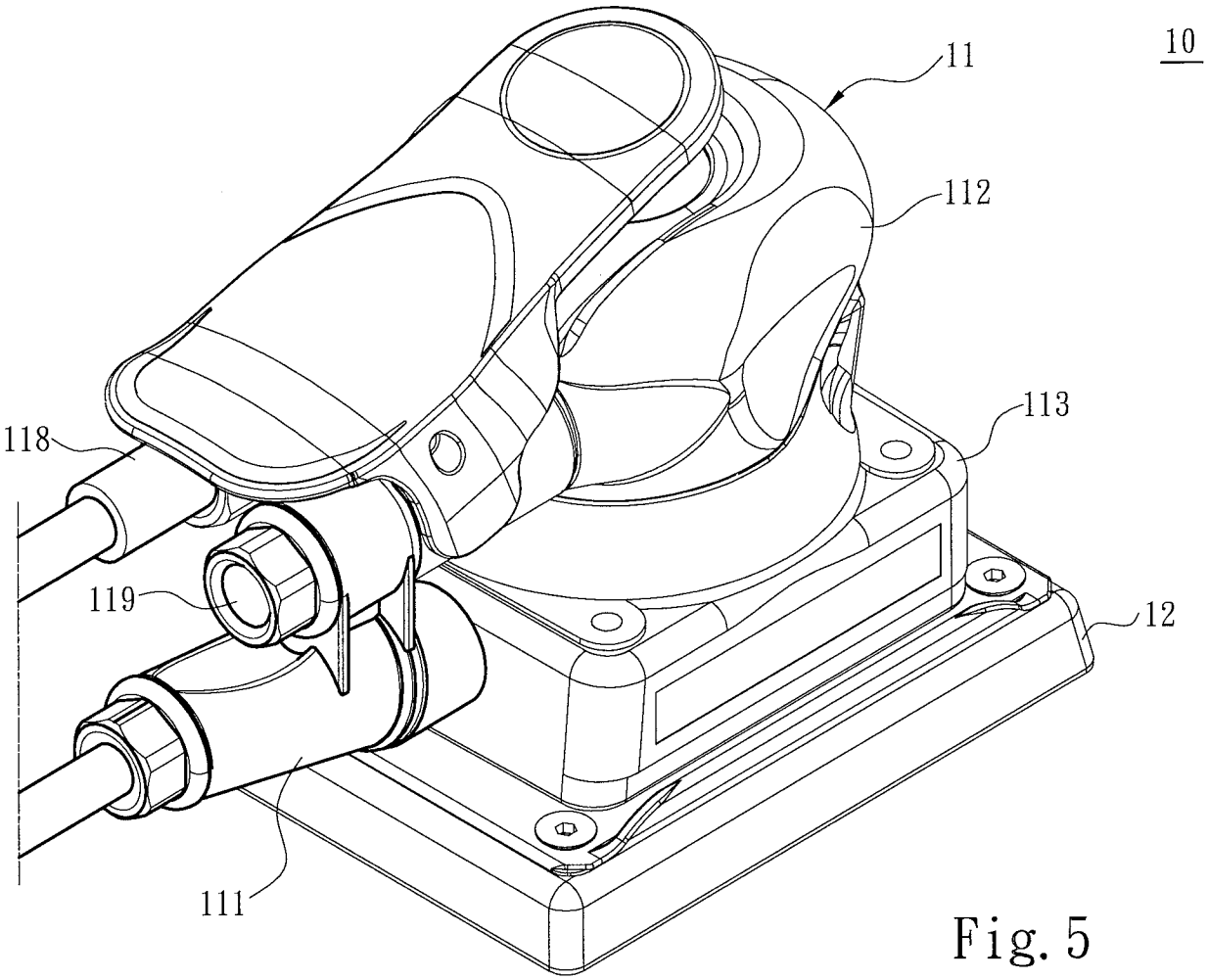
FIG. 5 is a structural schematic diagram of a grinding machine according to another embodiment of the present invention.

In addition to the circular form depicted in FIG. 1 to FIG. 4, the grinding disc 12 of the present invention may also be implemented in a square form, as shown in FIG. 5. When the grinding disc 12 is in a square form, implementation concepts are the same and shall be omitted herein.

Figure 6:
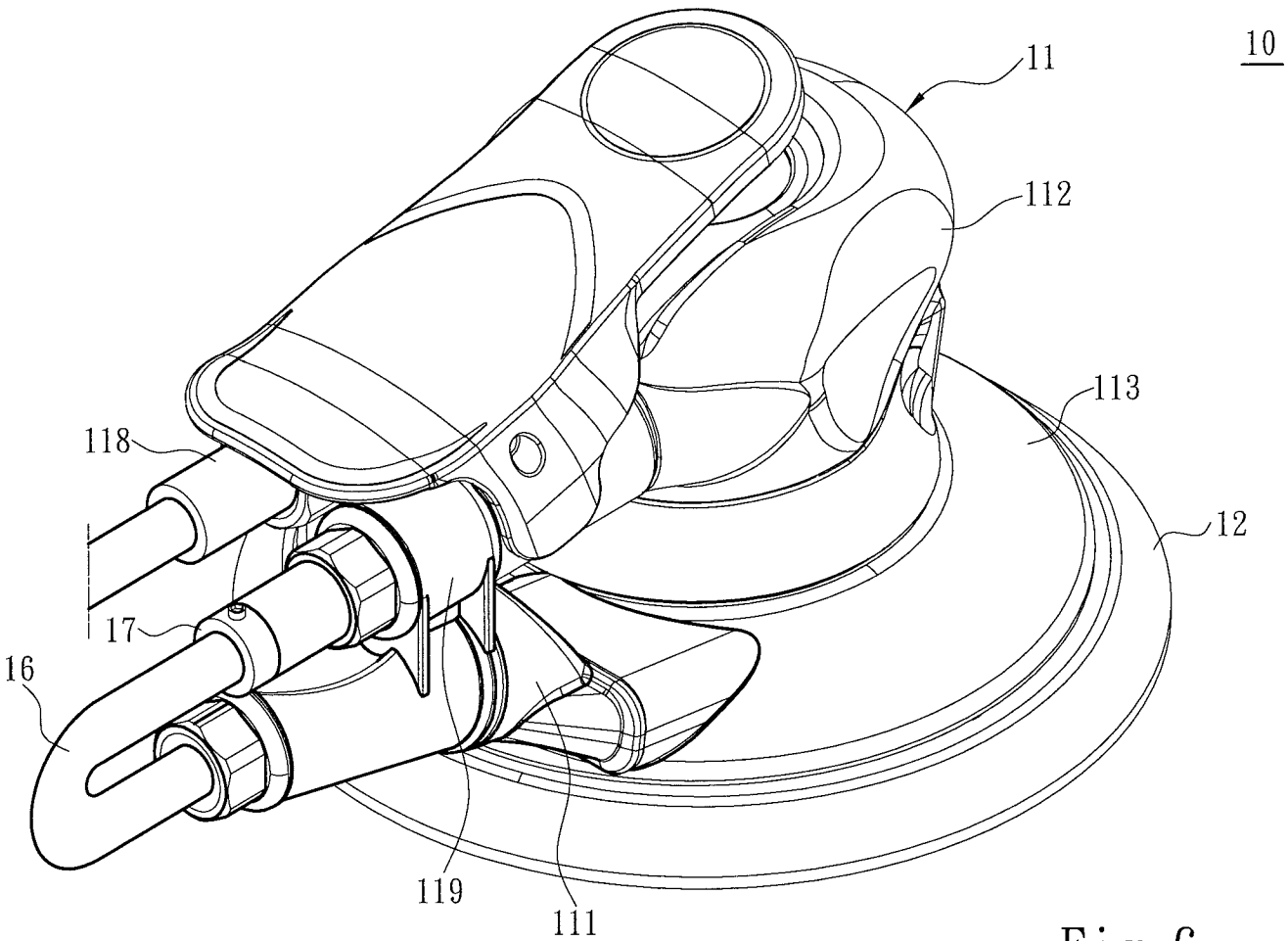
FIG. 6 is a structural schematic diagram of a grinding machine according to another embodiment of the present invention.
Figure 8:
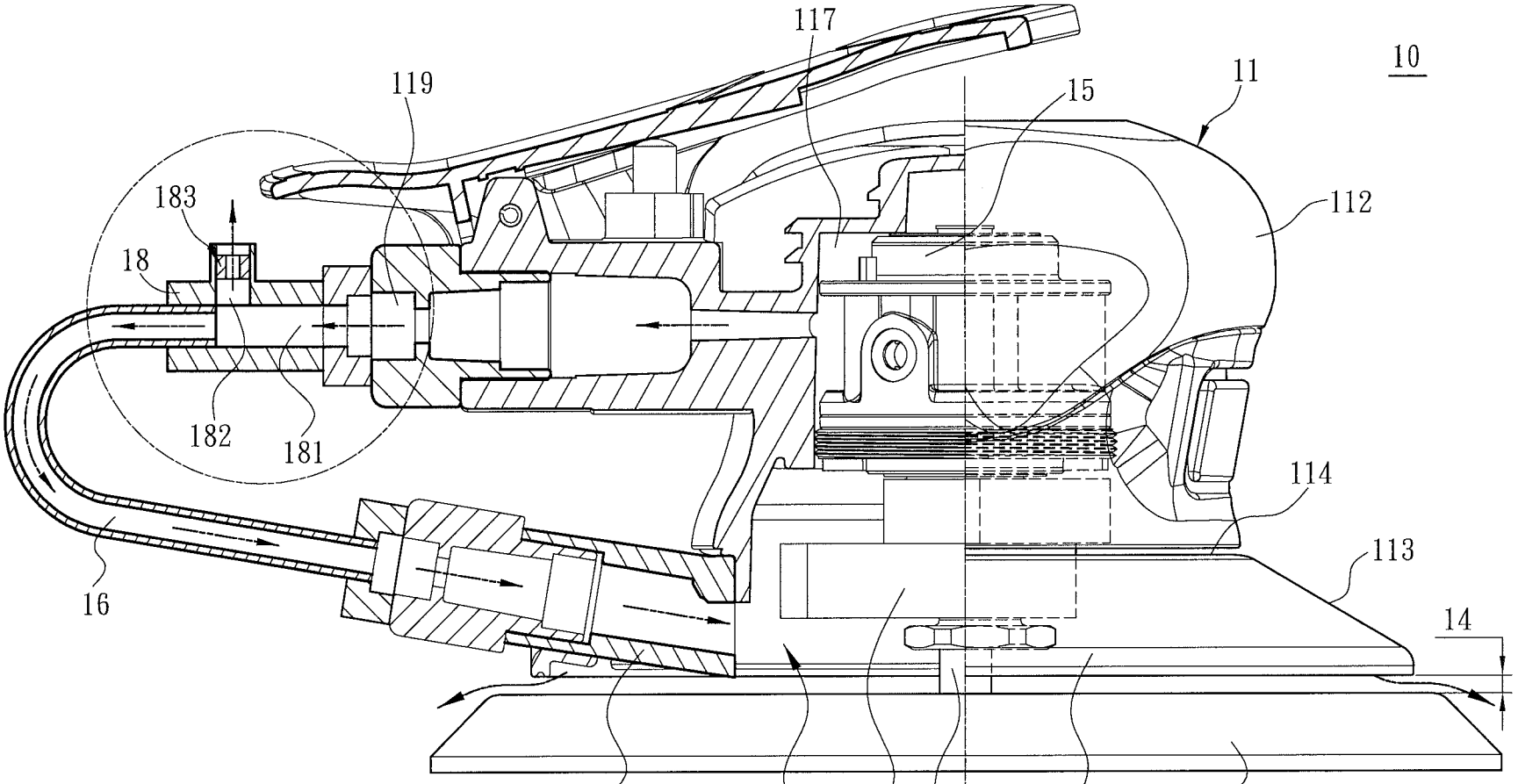
FIG. 8 is a schematic diagram of a high-pressure gas in flow according to an embodiment of the present invention.

Referring to FIG. 6 and FIG. 8, the host housing 112 includes a cavity 117 for disposing the power assembly 15, an gas intake channel 118 connected to the cavity 117 and for receiving the high-pressure gas from the external gas source, and a gas output channel 119 in communication with the cavity 117 and for discharging the high-pressure gas out of the cavity 117. The gas intake channel 118 receives the high-pressure gas into the cavity 117. The high-pressure gas drives the power assembly 15 to rotate, which further drives the grinding disc 12 to rotate for grinding. Further, in addition to the foregoing gas intake approach, in one embodiment, the grinding machine body 11 includes a gas guiding pipe 16, which has its two ends respectively connected to the gas output channel 119 and the gas intake pipe 111. The gas guiding pipe 16 receives the high-pressure gas discharged from the gas output channel 119, and guides the high-pressure gas into the pressure cavity 13. As such, the high-pressure gas is effectively utilized to prevent the high-pressure gas from becoming waste gas after only a one-time operation.

Figure 7:
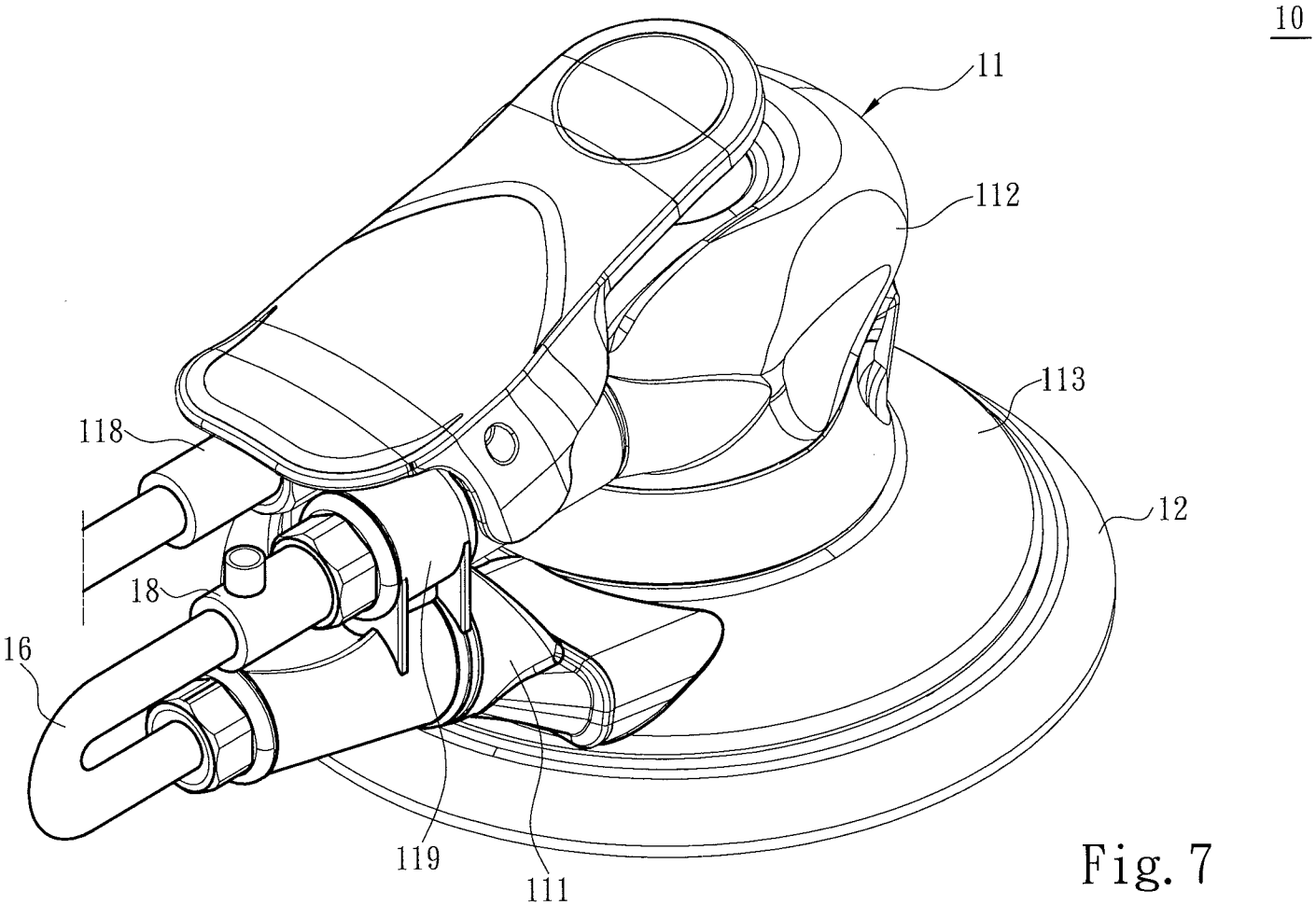
FIG. 7 is a structural schematic diagram of a grinding machine according to another embodiment of the present invention.
Figure 9:
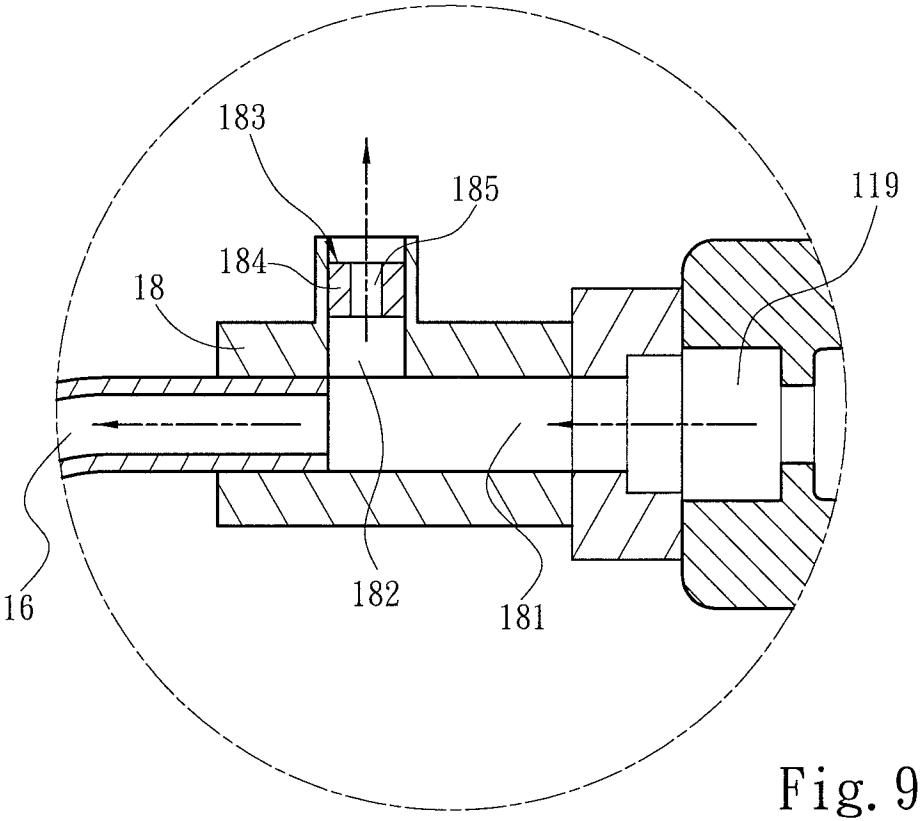
FIG. 9 is an enlarged partial schematic diagram of FIG. 8 of the present invention.

Referring to FIG. 6, the grinding machine body 11 may further include a regulating valve 17, which is connected between the gas output channel 119 and the gas guiding pipe 16. Through the regulating valve 17, the amount of the high-pressure gas entering the pressure cavity 13 through the gas guiding pipe 16 is controlled. Further, there are numerous types of the regulating valve 17, and associated details shall be omitted herein. During an application process of the regulating valve 17, as shown in FIG. 8, the regulating valve 17 may release a part of the high-pressure gas to reduce the amount of the high-pressure gas entering the gas guiding pipe 16. Referring to FIG. 7 to FIG. 9, in one embodiment, the grinding machine body 11 may further include a coupling tube 18. The coupling tube 18 includes a first channel 181 connected to the gas output channel 119 and the gas guiding pipe 16, and a second channel 182 branched from and remaining in communication with the first channel 181 and allowing a part of the high-pressure to be released. More specifically, an inner channel diameter of the second channel 182 affects the releasable amount of the high-pressure gas. In one embodiment, a deflation control member 183 is disposed in the second channel 182. The deflation control member 183 includes a plug body 184 and a through hole 185 disposed on the plug body 184. The aperture size of the through hole 185 determines a pressure release status of the deflation control member 183. When the aperture of the through hole 185 is larger, the deflation control member 183 releases a larger amount of the high-pressure gas and reduces the amount of the high-pressure gas entering the gas guiding pipe 16. Conversely, when the aperture of the through hole 185 is smaller, the deflation control member 183 is incapable of discharging a large amount of the high-pressure gas, such that the amount of the high-pressure gas entering the gas guiding pipe 16 is larger than that when the aperture of the through hole 185 is larger.

What is claimed is:

1. A grinding machine, comprising a grinding machine body and a grinding disc, wherein:

the grinding machine body is provided with a pressure cavity at a position facing the grinding disc and a gas intake pipe corresponding to the pressure cavity, a pressure release gap in communication with the pressure cavity is formed between the grinding machine body and the grinding disc, the gas intake pipe induces a high-pressure gas into the pressure cavity, the pressure cavity receives an effect of the high-pressure gas to cause a pressure therein to be greater than a pressure outside the grinding machine body such that the pressure cavity becomes a positive-pressure environment, and the pressure cavity is in communication with the pressure release gap to cause the high-pressure gas to be continually released via the pressure release gap, thereby prohibiting external dust from entering the pressure cavity.

2. The grinding machine of claim 1, wherein the gas intake pipe is connected to an external gas source and receives the high-pressure gas from the external gas source.

3. The grinding machine of claim 2, wherein the grinding machine body comprises a host housing and a cover body connected to the host housing, the gas intake pipe is disposed on the cover body, the cover body defines the pressure cavity, and one side of the cover body facing the grinding disc is hollow to allow the high-pressure gas to flow towards the pressure release gap.

4. The grinding machine of claim 3, wherein the cover body comprises a first end connected to the host housing and a second end facing the grinding disc, and a size of the second end is greater than a size of the first end.

5. The grinding machine of claim 3, wherein the grinding machine body comprises a connecting member, which is disposed at the cover body and causes the grinding disc to be linked with a power assembly disposed in the host housing.

6. The grinding machine of claim 1, wherein the grinding machine body comprises a host housing and a gas guiding pipe, the host housing comprises a cavity for disposing a power assembly, a gas intake channel in communication with the cavity and for receiving the high-pressure gas from an external gas source, and a gas output channel in communication with the cavity and for discharging the high-pressure gas out of the cavity, and two ends of the gas guiding pipe are respectively connected to the gas output channel and the gas intake pipe to guide the high-pressure gas into the pressure cavity.

7. The grinding machine of claim 6, wherein the grinding machine body comprises a regulating valve connected between the gas output channel and the gas guiding pipe.

8. The grinding machine of claim 7, wherein the grinding machine body comprises a cover body connected to the host housing, the gas intake pipe is disposed on the cover body, the cover body defines the pressure cavity, and one side of the cover body facing the grinding disc is hollow to allow the high-pressure gas to flow towards the pressure release gap.

9. The grinding machine of claim 8, wherein the cover body comprises a first end connected to the host housing and a second end facing the grinding disc, and a size of the second end is greater than a size of the first end.

10. The grinding machine of claim 6, wherein the grinding machine body comprises a coupling tube, which comprises a first channel connected to the gas output channel and the gas guiding pipe and a second channel branched from and in communication with the first channel and allowing a part of the high-pressure gas to be released.

11. The grinding machine of claim 10, wherein the coupling tube comprises a deflation control member disposed in the second channel, and the deflation control member comprises a plug body and a through hole disposed on the plug body.

12. The grinding machine of claim 11, wherein the grinding machine body comprises a cover body connected to the host housing, the gas intake pipe is disposed on the cover body, the cover body defines the pressure cavity, and one side of the cover body facing the grinding disc is hollow to allow the high-pressure gas to flow towards the pressure release gap.

13. The grinding machine of claim 12, wherein the cover body comprises a first end connected to the host housing and a second end facing the grinding disc, and a size of the second end is greater than a size of the first end.

14. The grinding machine of claim 10, wherein the grinding machine body comprises a cover body connected to the host housing, the gas intake pipe is disposed on the cover body, the cover body defines the pressure cavity, and one side of the cover body facing the grinding disc is hollow to allow the high-pressure gas to flow towards the pressure release gap.

15. The grinding machine of claim 14, wherein the cover body comprises a first end connected to the host housing and a second end facing the grinding disc, and a size of the second end is greater than a size of the first end.

16. The grinding machine of claim 6, wherein the grinding machine body comprises a cover body connected to the host housing, the gas intake pipe is disposed on the cover body, the cover body defines the pressure cavity, and one side of the cover body facing the grinding disc is hollow to allow the high-pressure gas to flow towards the pressure release gap.

17. The grinding machine of claim 16, wherein the cover body comprises a first end connected to the host housing and a second end facing the grinding disc, and a size of the second end is greater than a size of the first end.

18. The grinding machine of claim 6, wherein the grinding machine body comprises a connecting member, which is disposed at a cover body and causes the grinding disc to be linked with the power assembly disposed in the cavity.

* * * * *